US005512029A

United States Patent [19]

Barnard et al.

[11] Patent Number: 5,512,029

[45] Date of Patent: Apr. 30, 1996

[54] EXERCISE AND TRAINING DEVICE

[76] Inventors: Charles Barnard, 2405 Grand Ave., #1050, Kansas City, Mo. 64141; Earl Bell, 7214 Woodsprings, Jonesboro, Ark. 72401

[21] Appl. No.: 267,483

[22] Filed: Jun. 29, 1984

[51] Int. Cl.[6] ..... A63B 21/04

[52] U.S. Cl. ..... 482/129; 482/93; 482/94; 482/124

[58] Field of Search ..... 482/54, 15, 43, 482/93, 94, 97, 121, 122, 123, 124, 129, 130; 273/1.5 A

[56] References Cited

U.S. PATENT DOCUMENTS

| | | | |
|---|---|---|---|
| 4,026,548 | 5/1977 | Birdwell | 482/129 |
| 4,685,671 | 8/1987 | Hagerman et al. | 482/129 |
| 4,968,028 | 11/1990 | Wehrell | 482/43 |
| 5,112,287 | 5/1992 | Brewes | 482/123 |
| 5,176,597 | 1/1993 | Bryne | 482/54 |
| 5,205,803 | 4/1993 | Zemitis | 482/121 |

OTHER PUBLICATIONS

MF Track & Field Catalog 1994, p. 27.
MF Track & Field Catalog 1991, p. 29.

*Primary Examiner*—Lynne A. Reichard

*Attorney, Agent, or Firm*—Kokjer, Kircher, Bowman & Johnson

[57] ABSTRACT

An exercise device is provided for improving an user's speed and jumping ability. The device includes a base proximate the user's feet and having at least opposed side members which serve as anchors. A belt is provided which is secured about the user's waist and connected to one end of each of a plurality of elastic bands. Opposite ends of each band are connected to the side members upon the base to remain anchored to the floor. The elastic bands provide resistance against upward movement and exert a downward force in addition to the natural force of gravity. The elastic bands may be interchanged for bands of different sizes to adjust the amount of downward force exerted upon the user. During operation, the user stands within the base and secures the belt around his/her waist. Next, the user runs in place, hops, jumps, performs sit ups and the like to effect neuro-muscular training.

9 Claims, 2 Drawing Sheets

EXERCISE AND TRAINING DEVICE

FIELD OF THE INVENTION

The present invention relates to an exercise device which facilitates neuromuscular training to enhance an athlete's quickness, stability, balance, vertical leap and the like.

BACKGROUND OF THE INVENTION

Athletes constantly explore new training techniques for improving their athletic performance, with emphasis upon those athletic characteristics of interest to their field. In many sports, such as track and field events, speed and power are of particular importance. Hence, training tools and techniques which focus upon these characteristics of the athlete are of particular interest.

In the early 80's Soviet athletes became quite dominant in certain track and field events, such as the pole vault. At least within the pole vault event, the Soviet athletes dominance was attributed to their speed and power upon the runway. Such speed and power was a direct consequence of their unorthodox training methods, which included jump squats as a core training tool. Jump squats involve the use of a bar and weights placed upon the shoulders of the athlete (similar to regular squats). With this weight in place, the athlete simply jumped as high as possible for ten to twenty repetitions per set and repeats this exercise multiple sets. Typically, these athletes utilized more than 200 pounds while performing jump squats. This training technique proved quite successful in improving their speed and power. However, jump squats brought with it certain extremely undesirable side effects. Particularly, the exercise created tremendous spinal compression each time the athlete landed. This is due to the substantial downward momentum generated by the weight as the athlete returned to the ground. This momentum produced a tremendous force upon the athlete's lower back and hips. Thus, extended use of jump squats fatigued, and produced problems, within the athlete's lower back and hips. Over time, these problems were so substantial as to outweigh any benefits achieved with respect to quickness and power.

Thus, a need remains within the industry to provide an exercise which affords the advantages of jump squats, without damaging the athlete's back.

SUMMARY OF THE INVENTION

It is an object of the present invention to provide an exercise apparatus which improves an athlete's speed and jumping ability by increasing the downward resistance experienced by the athlete's legs during training.

It is another object of the present invention to provide a training apparatus which increased a simulated gravitational force upon an user to enhance the user's athletic ability.

It is another object of the present invention to provide a training apparatus which avoids spinal compression while increasing the downward resistance exerted upon the athlete's legs.

It is another object of the present invention to provide an exercise device which affords the athlete higher knee lift while running, along with improved quickness, agility, balance and the like.

It is another object of the present invention to provide a single exercising apparatus which affords a variety of different exercises, including jump squats, high knees, skips, one leg hops, jogging, sit ups and the like to develop the aerobic and anaerobic strength of the athlete.

It is a further object of the present invention to provide an exercising device which is usable during the competitive season when an athlete desires to peak.

In summary, an exercise device is provided for improving an user's speed, power and jumping ability. The device includes a base proximate the user's feet and at least partially surrounding the user to serve as an anchor. A belt is provided which is secured about the user's waist. A plurality of elastic bands or springs interconnect the belt and the anchored base. The elastic bands or springs provide resistance against upward movement and exert a downward force in addition to the natural force of gravity. The elastic bands may be interchanged with bands of different sizes to adjust the amount of downward force exerted upon the user. During operation, the user stands within the base and secures the belt around his/her waist. Next, the user runs, hops, jumps, performs sit ups and the like to effect neuromuscular training.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
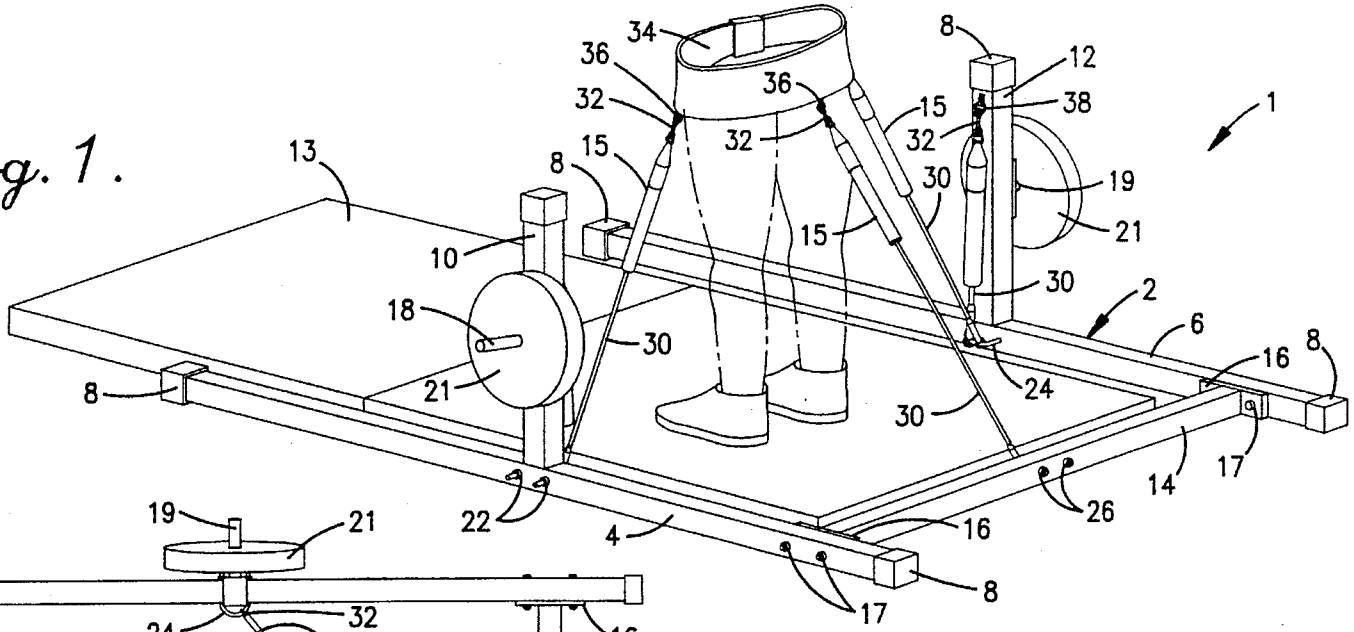
FIG. 1 illustrates a side perspective view of the present invention.
Figure 2:
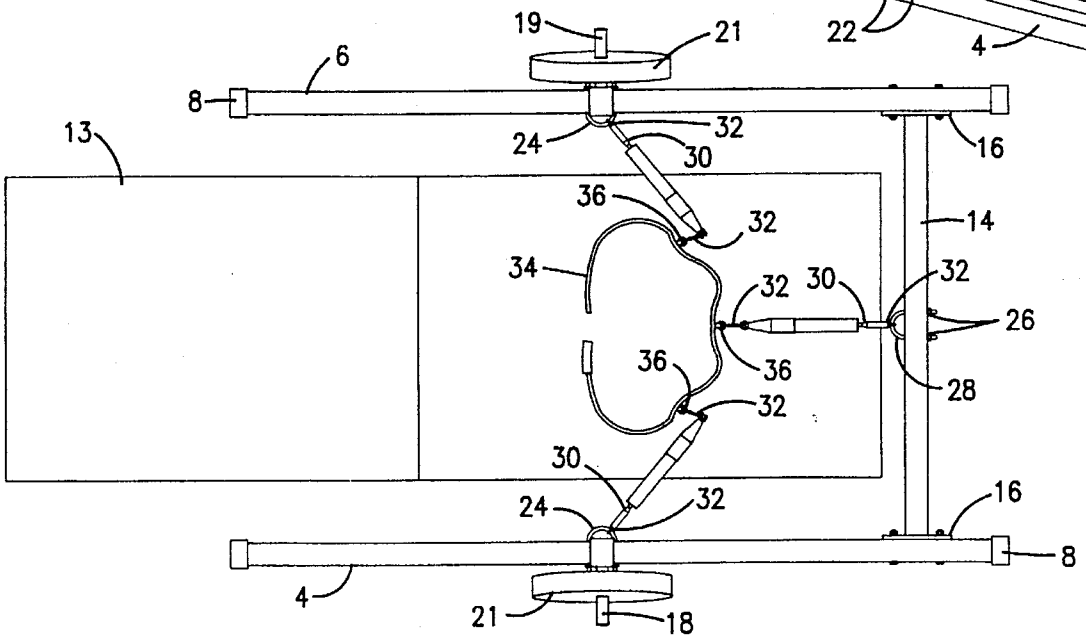
FIG. 2 illustrates a top planar view of the present invention with a user.

FIG. 1 generally illustrates the present invention as designated by the reference numeral 1. The exercise apparatus 1 includes a base 2 section which serves as an anchor while the apparatus 1 is in use. The base 2 includes a pair of side bars 4 and 6 aligned parallel to one another and formed of rectangular rigid tubing. Opposite ends of each side bar 4 and 6 receive protective covers 8 thereover, such as made of plastic or rubber to support the base 2. The protective covers 8 prevent the base 2 from scratching the floor and prevent injuries, such as kicking the corners thereof. A floormat 13 is provided for the user to exercise upon. The side bars 4 and 6 are interconnected via at least one crossbar 14 which includes flanges 16 on opposite ends thereof. The flanges 16 are bolted 17 to an inner side of the bars 4 and 6 to maintain a predetermined relation therebetween. Optionally, a front/crossbar (not shown) may be inserted between the side bars 4 and 6 proximate the opposite front end thereof to further support the structure. If a front crossbar is utilized, the side bars 4 and 6 merely need be sufficient in length to allow the athlete to exercise within the front and rear crossbars without interference therewith.

The side bars 4 and 6 include holes 22 therethrough which receive side U-shaped bolts 24. The side U-shaped bolts 24 extend horizontally through the side bars 4 and 6 from the inner wall to the outer wall. The crossbar 14 further includes holes 26 therethrough which receive an end U-shaped bolt 28 extending from its inner wall to the outer wall in a horizontal plane.

Figure 4:
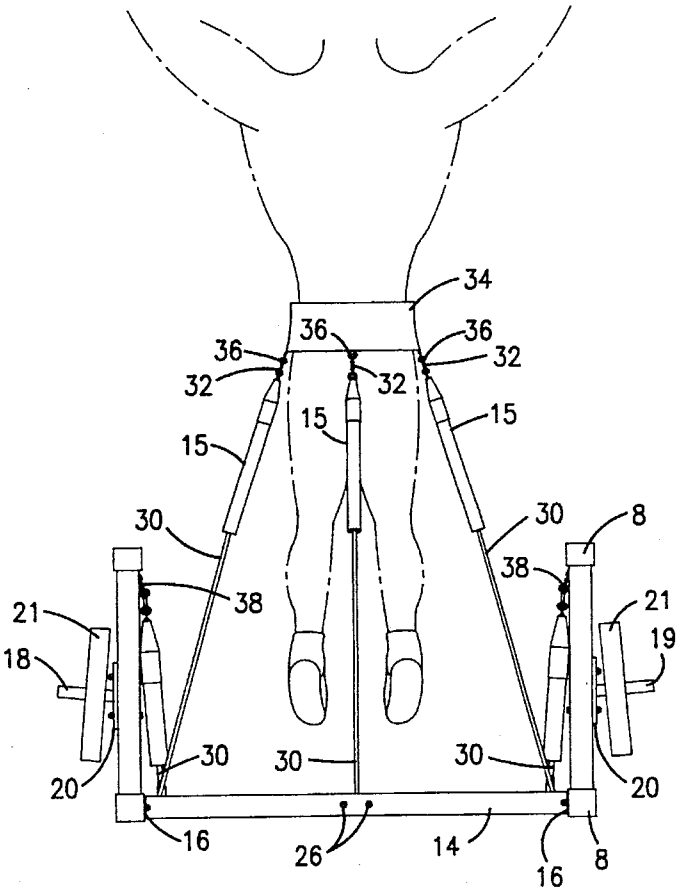
FIG. 4 illustrates a rear planar view of the present invention.

The side bars 4 and 6 further include vertical arms 10 and 12, respectively, located proximate the center of each bar and extending upward therefrom. The vertical arms 10 and 12 may be formed integrally with the side bars 4 and 6, or alternatively, may be permanently affixed thereto in any conventional manner. Upper ends of the vertical arms 10 and 12 receive protective covers 8 to prevent injury and the like. The side bars 4 and 6, vertical arms 10 and 12 and crossbars 14 are each formed of rigid hollow tubing, such as metal tubing, aluminum tubing and the like, so long as it affords sufficient strength to resist the forces exerted during use. The vertical arms 10 and 12 include weight supporting limbs 18 and 19 located on an outer surface thereof and extending outward to receive weights 21 (FIG. 4). The weight supporting limbs 18 and 19 are formed integrally with flanges 20 (FIG. 4) which include holes therethrough. The flanges 20 are bolted to the vertical arms 10 and 12. The weight supporting limbs 18 and 19 receive weights 21 to afford a sufficient anchoring force to enable the base 2 to resist movement during training.

Each of the side and end U-shaped bolts 24 and 28 receive one or more elastic bands 30, springs and the like. Specifically, each elastic band 30 includes hooks 32 on opposite ends thereof, one of which snappingly engages a corresponding U-shaped bolt 24 or 28. A weight belt 34 is utilized which is secured about the waist of a user, such as by VELCRO® (a trademark for fastening tape used especially for cloth products) buckles and the like. The belt 34 includes rings 36 on opposite sides thereof and optionally in the front and back. The rings 36 receive corresponding hooks 32, thereby securing each elastic band 30 to the user. Each elastic band is received within a rigid protective casing 15 which is secured, at one end, proximate the hook 32 engaging the belt 34. The casing 15 includes an opening in its lower end to allow the elastic band 30 to retract into, and stretch out of, the casing 15. The casings 15 protect the user from any potential injury resulting from failure of the bands 30 (e.g. if it breaks and also lengthens the life of the bands 30 by protecting the bands 30 from the environment, particularly ultra-violet light which causes degradation of the bands). The casings 15 are sufficient in length to receive a majority of the band 30 when retracted.

Optionally, each vertical arm 10 and 12 may include a storage clip 38 located on the upper end and proximate its inner side. The storage clips 38 allow excess elastic bands 30 to be snapped thereto, stored and retained out of the way during exercise. Each elastic band 30 affords a given amount of resistance depending upon its diameter and consistency. Any combination of bands 30 may be used, including one or more on each side of the user and/or one or more at the rear and front of the user.

As a further option, the bands 30 may be arranged at different points relative to the user, so long as they maintain an even force upon the user. Optionally, the bands 30 may be arranged at the "four corners" of the user (i.e., front left, front right, rear left and rear right corners). To do so, the U-shaped bolts merely need be moved to the front and rear corners of the side bars 4 and 6. Similarly, the rings 36 could be moved to the corresponding points along the belt 34.

Optionally, the belt 34 may be constructed as a harness with straps running over the user's shoulders.

As a further optional, the cross and side bars may be removed and a flat platform substituted therefore which covers the entire exercising area between the cross and side bars 4, 6 and 14. As a further option, the side bars 4 and 6 may rest upon, and be secured to, a flat platform like base. Any similar structure may be substituted for the side bars, crossbars and base platform, so long as it maintains a desired fixed distance, anchoring force and relation between the elastic bands 30 does not interfere with the athlete.

As a further option, the present invention may be modified to afford non-stationary exercises. For instance, the base may be configured as a sled which the user pulls during training via the bands 30. The sled would substantially surround the user (as in FIG. 1) with the side bars functioning as runners. A sled-type configuration would enable the user to run, such as in normally training, but would still exert excess gravity, thereby forcing the user to move his/her feet more quickly and to regain his/her balance faster. Optionally, the base may be provided with wheels on opposite sides thereof, to allow the user to run while using the invention. The wheels may be constructed with an adjustable brake to allow the user to vary the amount of resistance provided by the tires against forward motion. These moving embodiments would still maintain the base and bands proximate the user to simulate increased gravitational force upon the user.

Figure 3:
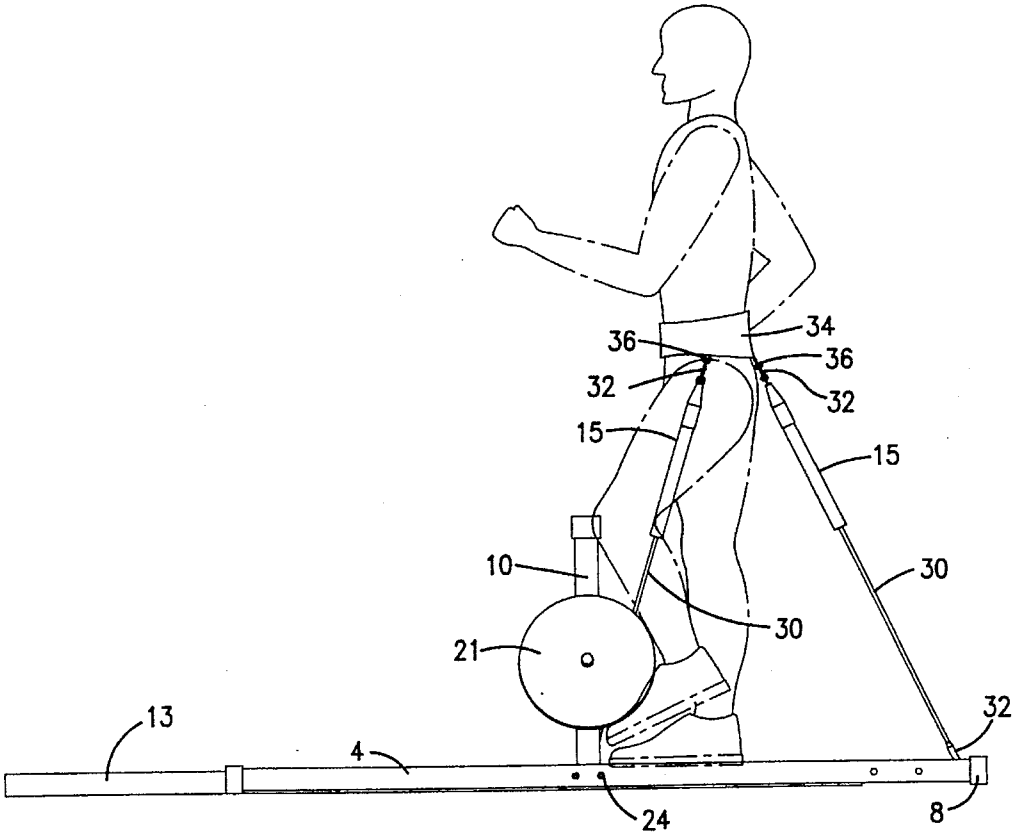
FIG. 3 illustrates a side planar view of the present invention while not in use.

FIGS. 3 and 4 illustrate exemplary exercises. During use, the base is set up with the desired elastic bands 30 in place snapped to the side and end bolts 24 and 28. A desired amount of weight is added to the weight support limbs 18 and 19. The amount of weight will depend upon the size of the elastic bands 30. Thereafter, the rings 36 upon the weight belt 34 are connected to the hooks 32 upon the desired number of elastic bands 30. Next, the user squats within the base 2 to his/her knees. When in this squatting position, the belt 34 may be easily secured about his/her waist while the bands 30 are in a relaxed retracted position. Next, the athlete stands and begins to perform the desired exercise. These exercises may include jump squats (FIG. 4), running in place with high knees (FIG. 3), skips, one leg hops, jogging, sit ups and the like. A variety of additional exercises may be performed to develop the athlete's aerobic and anaerobic strength.

As the athlete performs the given exercise, the elastic bands 30 provide a continuous downward resistance upon the weight belt 34. Hence, if the athlete jumps, he/she returns to the ground quicker than he/she would under normal conditions. Absent the present invention, when a person jumps, he/she returns to the ground at 32 ft./second$^2$. This rate of return remains constant regardless of the weight of, or weight added, to the athlete (such as in the conventional jump squats). However, when the athlete is connected to the present invention, the elastic bands 30 provide an additional downward force and simulate excess gravity, thereby causing the athlete to return to the ground at a rate much greater than 32 ft./second$^2$. This simulated gravity requires the athlete to react faster, regain stability and obtain balance more quickly. Consequently, the athlete's muscle fibers controlling quickness are stressed and thus greatly enhanced, along with that portion of the athletes neurological system which controls quickness and balance. These improvements in the neuromuscular development of the athlete afford substantial gains in speed, power and quickness.

Additionally, by attaching the weight belt 34 about the athlete's waist, the downward forces of the bands 30 are exerted upon the athlete's lower torso below the spine. Thus, the athlete does not experience spinal compression. Hence, the present invention avoids the disadvantages of conventional jump squats with a weight bar while achieving more advantages.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An exercising apparatus for improving a user's athletic ability, said apparatus comprising:

a base;

fastening means adapted to be securely fastened about the user's waist;

elastic means secured between said base and said fastening means for resisting upward movement of, and exerting downward force, upon said fastening means while the user exercises; and an adjustable anchor, attached to the base, to provide an adjustable downward anchoring force to counteract upward forces experienced during exercise.

2. An exercise apparatus according to claim 1, wherein said elastic means includes at least two elastic bands mounted on opposite sides of said fastening means and to said base.

3. An exercise apparatus according to claim 1, wherein said elastic means includes a plurality of elastic bands that are interchangeable to adjust an amount of downward force exerted upon said fastening means.

4. An exercise apparatus according to claim 1, wherein said bas includes side bars extending parallel to one another and interconnected at, at least, one end with a crossbar to maintain a predetermined distance and relation between said side bars and to define an open exercising area of the workout surface.

5. An exercise apparatus according to claim 1, wherein said side bars include bolting means, proximate centers thereof, for securing to a lower end of said elastic means, said fastening means having hook means, thereon, for securing to an upper end of said elastic means.

6. An exercise apparatus according to claim 1, wherein said elastic means include multiple elastic bands sets, each set of which exhibits a different amount of resistance, each band within any given set exhibiting a common amount of resistance.

7. An exercise apparatus according to claim 1, wherein said elastic means includes at least one elastic band and protective tubing means, surrounding said elastic band, for protecting the user from injury when said elastic band breaks and for protecting said elastic band from ultra-violet light to lengthen the life thereof.

8. An exercise apparatus according to claim 1, wherein said base is U-shaped to provide an open exercise area which does not interfere with the feet of the user.

9. An exercising apparatus for improving a user's athletic ability, said apparatus comprising:

a base proximate the user's feet an adjustable anchor, secured to said base, to provide an anchoring force;

fastening means securely fastened about the user's waist; and at least one elastic band secured between said base and said fastening means for resisting upward movement of, and exerting downward force, upon said fastening means while the user exercises.

* * * * *

UNITED STATES PATENT AND TRADEMARK OFFICE

CERTIFICATE OF CORRECTION

PATENT NO. : 5,512,029

DATED : April 30, 1996

INVENTOR(S) : Charles Barnard and Earl Bell

It is certified that error appears in the above-indentified patent and that said Letters Patent is hereby corrected as shown below: Title page, Item [22]:

The filing date listed is June 29, 1984 and should be June 29, 1994.

Signed and Sealed this

First Day of September, 1998

Bruce Lehman

*Attest:*

BRUCE LEHMAN

*Attesting Officer*

*Commissioner of Patents and Trademarks*